US006688299B2

(12) United States Patent
Kim

(10) Patent No.: US 6,688,299 B2
(45) Date of Patent: Feb. 10, 2004

(54) SHOOTING GAME APPARATUS USING COMPRESSED AIR

(75) Inventor: Yong Hwan Kim, Seoul (KR)

(73) Assignee: Andamiro Co., Ltd., Seoul (KR)

( * ) Notice: Subject to any disclaimer, the term of this patent is extended or adjusted under 35 U.S.C. 154(b) by 2 days.

(21) Appl. No.: 10/041,745

(22) Filed: Jan. 8, 2002

(65) Prior Publication Data

US 2003/0005917 A1 Jan. 9, 2003

(30) Foreign Application Priority Data

| | | |
|---|---|---|
| Jul. 9, 2001 | (KR) | 2001-40932 |
| Jul. 9, 2001 | (KR) | 2001-40934 |
| Oct. 22, 2001 | (KR) | 2001-32230 |
| Oct. 22, 2001 | (KR) | 2001-32233 |
| Oct. 22, 2001 | (KR) | 2001-32236 |

(51) Int. Cl.[7] ..... F41B 11/00
(52) U.S. Cl. ..... 124/59; 273/368
(58) Field of Search ..... 124/59, 65–73; D21/465, 466, 467; 273/348, 359, 368

(56) References Cited

U.S. PATENT DOCUMENTS

| | | | | | |
|---|---|---|---|---|---|
| 4,207,857 | A | * | 6/1980 | Balka, Jr. | 124/56 |
| 4,770,153 | A | * | 9/1988 | Edelman | 124/72 |
| 4,875,459 | A | * | 10/1989 | Van Elderen et al. | 124/49 |
| 5,251,906 | A | * | 10/1993 | Heller et al. | 273/397 |
| 5,415,152 | A | * | 5/1995 | Adamson et al. | 124/59 |
| 5,505,188 | A | * | 4/1996 | Williams | 124/74 |
| 5,819,715 | A | | 10/1998 | Haneda et al. | |
| 5,913,304 | A | * | 6/1999 | Johnson | 124/59 |
| 6,065,460 | A | * | 5/2000 | Lotuaco, III | 124/72 |
| 6,152,125 | A | * | 11/2000 | Piper | 124/59 |
| 6,217,026 | B1 | * | 4/2001 | Kang | 273/368 |
| 6,360,736 | B1 | * | 3/2002 | Juan | 124/77 |
| 6,467,772 | B2 | * | 10/2002 | Tamura et al. | 273/355 |
| 2002/0088449 | A1 | * | 7/2002 | Perrone | 124/74 |
| 2003/0024520 | A1 | * | 2/2003 | Dobbins | 124/73 |

* cited by examiner

*Primary Examiner*—Peter M Poon
*Assistant Examiner*—David J Parsley
(74) *Attorney, Agent, or Firm*—Harness, Dickey & Pierce, P.L.C.

(57) ABSTRACT

A shooting game apparatus including a housing, an air compressor installed in the housing, and least one shooting apparatus for launching bullets using compressed air generated by the air compressor. The shooting game apparatus further including a bullet shooting pressure supplying device for supplying relatively high pressure to the shooting apparatus so as to launch the bullets, a bullet delivering pressure supplying device for supplying relatively low pressure using the compressed air to deliver bullets to the shooting apparatus, a pressure distributing valve for distributing the compressed air generated by the air compressor to the bullet shooting pressure supplying device and to the bullet delivering pressure supplying device, and a controller which is electrically connected to the air compressor, the shooting apparatus, the bullet shooting pressure supplying device, the bullet delivering pressure supplying device and the pressure distributing valve for controlling thereof.

12 Claims, 9 Drawing Sheets

SHOOTING GAME APPARATUS USING COMPRESSED AIR

FIELD OF THE INVENTION

The present invention relates to a shooting game apparatus, in particular to the shooting game apparatus in which a bullet is delivered from a bullet supplying apparatus to a shooting apparatus using relatively low pressured compressed air and shot from the shooting apparatus using relatively high pressed compressed air.

DESCRIPTION OF THE PRIOR ART

Generally, a shooing game playing by hitting a target with a shooting apparatus such as a gun or a bow has been widely enjoyed so far and moreover computer simulation shooting game is getting developed recently. Among those shooting games, a shooting game using compressed air has been mostly enjoyed because vibration or explosion sound generated when a bullet is shot from the shooting apparatus gives truthfulness to gamers. Further, in case that a target is a premium such as a doll, gamers can more enjoy the game because they have a lot of choice on the premium and get the premium on the spot when the target is hit.

However, there are problems relating to a conventional shooting game apparatus using compressed air. The compressed air generated by air compressor is directly supplied to a plurality of shooting apparatuses, so that pressure of the compressed air supplied to the shooting apparatus can be varied depending on number of the shooting apparatuses and distance between the shooting apparatuses and the air compressor. Thus, pressures supplied to each of the shooting apparatuses can be different from each other. As a result, it is difficult to expect reliable launching rapidity or straight forwarding of bullets.

Further, moisture generated by the air compressor that is installed into the shooting game apparatus is collected in a catch vessel. Accordingly, in case that the moisture collected in the catch vessel is not removed at a proper time, water is flowing over into the shooting game apparatus, so that the apparatus is easily rusted away. To avoid rusting of compartments of the shooting game apparatus and keep clean it, dewater must be regularly performed. By the way, it takes a lot of maintenance time and cost to dewater the shooting game apparatus.

Still further, conventional bullet supply apparatus could not rapidly supply a lot of bullets to a shooting apparatus due to small capacity of magazine that stores bullets. Further, operation of the bullet supply apparatus is not stable and the bullet supply apparatus is easily out of order because mechanical mechanism of the conventional bullet supply apparatus is so complicated as well as the bullet supply apparatus operates in response to on-off operation of solenoid. The bullet is delivered from the magazine to the shooting apparatus using the compressed air, so that delivering path is so long. Therefore, the bullet could not be smoothly transferred in case there is height difference between a position of the shooting apparatus and a position of the bullet supply apparatus.

Further, the bullet used in the shooting game apparatus using the compressed air is easily broken or smashed, so that size of the bullet become smaller than the standardized size. On the other hand, shape of the bullet that is initially spherical is deteriorated to become oval far from the standardized shape because the bullet is crashed against the inside wall of the shooting apparatus or a target. The conventional bullet supply apparatus could not sort the deteriorated or broken bullet, so that a plurality of problems happened.

Further, the conventional shooting game apparatus needs so many compartments such as a spool that is installed into the shooting apparatus and moves a bullet, a solenoid which operates the spool, and a compressed air transferring tube that transfers compressed air to a solenoid valve, so that manufacturing cost of the shooting game apparatus was high. Further, assembly work of the apparatus is difficult and productivity is low because mechanism of the conventional shooting game apparatus is complicated. Further, reliability of the conventional shooting game apparatus is low because the solenoid electrically operated or the compressed air transferring tube can easily be out of order due to careless of a gamer or a user.

SUMMARY OF THE INVENTION

It is, therefore, an object of the present invention is to provide a shooting game apparatus which is capable of supplying compressed air at uniform pressure to a plurality of shooting apparatuses regardless of number of shooting apparatuses or a distance between the shooting apparatuses and air compressor.

It is, therefore, another object of the present invention is to provide a shooting game apparatus that is capable of reducing maintenance time and cost by automatically drying moisture generated by an air compressor that is installed into the shooting game apparatus.

It is, therefore, further another object of the present invention is to provide a shooting game apparatus that is capable of continuously supplying a lot of bullets to a shooting apparatus at regular intervals.

It is, therefore, still another object of the present invention is to provide a trouble free shooting game apparatus that has simple structure.

It is, therefore, still further another object of the present invention is to provide a shooting game apparatus having a bullet supply apparatus that is capable of stably supplying bullets to a shooting apparatus.

It is, therefore, another object of the present invention is to provide a shooting game apparatus having a bullet supply apparatus that is capable of supplying only normal bullets having standardized shape and size to a shooting apparatus by sorting bullets to remove abnormal bullets.

It is, therefore, another object of the present invention is to provide a shooting game apparatus having a bullet sorting apparatus that is capable of removing abnormal or damaged bullets that have sizes smaller or bigger than the normal bullets.

It is, therefore, another object of the present invention is to provide a shooting game apparatus having a motor overload prevention apparatus that is capable of smoothly transferring rotary power of a motor to a rotating shaft and protecting a motor from being damaged by suppressing overload of the motor when a motor is not rotated.

It is, therefore, another object of the present invention is to provide a shooting game apparatus that can be easily assembled due to its simple structure. Therefore productivity and reliability of the shooting apparatus will be raised and not be easily malfunctioned.

In accordance with a first aspect of the present invention, there is provided a shooting game apparatus having a housing, an air compressor installed in the housing, and at least one shooting apparatus for shooting a bullet using compressed air supplied from the air compressor, comprising: a bullet shooting pressure supplying means for supplying relatively high pressure using compressed air generated by the air compressor to the shooting apparatus so as to shoot a bullet; a bullet delivering pressure supplying means for supplying relatively low pressure using compressed air generated by the air compressor to deliver a bullet so as to the shooting apparatus; and a controller which is electrically connected to the air compressor, the shooting apparatus, the bullet shooting pressure supplying means and the bullet delivering pressure supplying means for controlling thereof.

In accordance with the first aspect of the present invention, the bullet shooting pressure supplying means includes a bullet shooting pressure adjusting valve that is installed on a bullet shooting pressure transferring tube connecting the air compressor with the shooting apparatus for adjusting pressure of the compressed air to be supplied to the shooting apparatus.

In accordance with the first aspect of the present invention, the bullet shooting pressure supplying means further includes an auxiliary tank that is installed between the air compressor and the bullet shooting pressure adjusting valve for temporarily storing compressed air distributed by the air compressor.

In accordance with the first aspect of the present invention, the bullet delivering pressure supplying means includes a pressure reducing valve which is installed on the bullet delivering pressure transferring tube connecting the air compressor with the shooting apparatus for reducing pressure of the compressed air distributed from the air compressor.

In accordance with the first aspect of the present invention, the bullet delivering pressure supplying means further includes at least one bullet delivering pressure adjusting valve which is installed between the pressure reducing valve and the shooting apparatus for adjusting reduced pressure of the compressed air.

In accordance with the first aspect of the present invention, the bullet delivering pressure supplying means further includes a low pressure controlling valve which is installed between the bullet delivering pressure adjusting valve and the shooting apparatus for supplying compressed air to a selected shooting apparatus.

In accordance with the first aspect of the present invention, the bullet delivering pressure supplying means further includes a low pressure controlling valve which is installed between the bullet delivering pressure adjusting valve and the shooting apparatus for supplying compressed air to a selected shooting apparatus.

In accordance with the first aspect of the present invention, wherein the shooting game apparatus further comprises an air filter for filtering the compressed air so as to remove moisture or contaminant contained in the compressed air generated by the air compressor, wherein the air filter is installed inside a high pressure tube connecting the air compressor and the bullet shooting pressure supplying means.

In accordance with the first aspect of the present invention, the shooting game apparatus further comprises a bullet sorting apparatus.

In accordance with the first aspect of the present invention, the bullet sorting apparatus includes a bullet line-up means for lining up bullets, a bullet selecting means having a pair of selecting bars for selecting the bullets depending on distance between the pair of selecting bars, and a driving means which is connected to the bullet selecting means at one end portion thereof for providing rotary power to the bullet selecting means.

In accordance with the first aspect of the present invention, the bullet line-up means includes a base plate downwardly slopped and a line-up plate arranged perpendicularly to the base plate and separated from the base plate.

In accordance with the first aspect of the present invention, the bullet line-up means further includes a guide plate perpendicularly arranged to the base plate and not being separated from the base plate for guiding the bullets to the line-up plate.

In accordance with the first aspect of the present invention, the bullet shorting means includes a first selecting bar having spiral grooves formed on outer surface thereof and a second selecting bar separately arranged from the first selecting bar, wherein the bullets are supplied in a space between the first selecting bar and the second selecting bar.

In accordance with the first aspect of the present invention, the first selecting bar comprises three zones (first zone, second zone and third zone) depending on difference of depth of the spiral grooves, in which the first zone is formed for selecting bullets smaller than normal size of bullets or contaminant, the second zone is formed for selecting normal size of bullets, and the third zone is formed for selecting big gullets bigger than normal size of bullets or contaminant.

In accordance with the first aspect of the present invention, the second selecting bar comprises three zones (first zone, second zone, third zone) depending on difference of diameter of the second selecting bar, wherein the first zone is formed for selecting bullets smaller than normal size of bullets or contaminant, the second zone is formed for selecting normal size of bullets, and the third zone is formed for selecting big gullets bigger than normal size of bullets or contaminant.

In accordance with the first aspect of the present invention, the shooting game apparatus further comprises a bullet collecting section installed under the bullet selecting means to collect and supply the normal size of bullets.

In accordance with the first aspect of the present invention, the shooting game apparatus further comprises a motor overload prevention apparatus between the driving means and the first selecting bar.

In accordance with the first aspect of the present invention, the motor overload prevention apparatus includes: a first coupling installed on a driving shaft for transferring rotary power of the driving means to the driving shaft; a second coupling installed on an outputting shaft which operates by receiving the rotary power of the driving shaft; and a rotary power transfer means for transferring rotary power of the driving means from the first coupling to the second coupling, wherein the rotary power transfer means includes elastic members inserted into each of inserting holes formed on side surface of the front section of the first coupling and balls being received in the elastic members, the second coupling having inserting holes for receiving a part of the each ball on a side surface to which the first coupling is contacted.

In accordance with the first aspect of the present invention, the inserting holes are formed in radial type at regular intervals.

In accordance with the first aspect of the present invention, a separation protection member is fixed at entrance portion of each of the inserting holes.

In accordance with the first aspect of the present invention, the shooting apparatus includes: a main body having a handle; a bullet magazine which receives low pressured compressed air supplied by a compressed air transferring means and is installed in the handle; a bullet shooting tube which is directed to a muzzle of the shooting apparatus and connected to the bullet magazine and receiving high pressured compressed air supplied from the compressed air transferring means; a trigger for directly pushing bullets charged in the magazine to the bullet shooting tube by being pulled by a gamer; and a sensor for detecting movement of the trigger and controlling opening and closing of high pressure pipe using a controller.

In accordance with the first aspect of the present invention, the trigger includes: a body; a sensing part which is formed to be protruded from one side of the body and movement thereof is detected a sensor; a pushing part which is formed to be protruded from the other side of the body and pushing the bullets charged in the bullet magazine to the bullet shooting tube; and an elastic member which is interfered between the body of the trigger and the main body of the shooting apparatus for providing the trigger with restoration.

In accordance with the second aspect of the present invention, there is provided a shooting game apparatus having a housing, an air compressor installed in the housing and at least one shooting apparatus for launching bullets using compressed air supplied from the air compressor, comprising: bullet shooting pressure supplying means for supplying relatively high pressure using compressed air generated by the air compressor to the shooting apparatus to launch a bullet; bullet delivering pressure supplying means for supplying relatively low pressure using compressed air generated by the air compressor to deliver a bullet to the shooting apparatus; a pressure distributing valve which is connected with the air compressor and the high pressure tube for distributing compressed air generated by the air compressor to the bullet shooting pressure supplying means and the bullet delivering pressure supplying means; and a controller which is electrically connected to the air compressor, the shooting apparatus, the bullet shooting pressure supplying means and the bullet delivering pressure supplying means for controlling thereof.

In accordance with the second aspect of the present invention, the bullet shooting pressure supplying means includes a bullet shooting pressure adjusting valve that is installed on a bullet shooting pressure transferring tube connecting the air compressor with the shooting apparatus for adjusting pressure of the compressed air to be supplied to the shooting apparatus.

In accordance with the second aspect of the present invention, the bullet shooting pressure supplying means further includes an auxiliary tank that is installed between the air compressor and the bullet shooting pressure adjusting valve for temporary storing compressed air distributed from the air compressor.

In accordance with the second aspect of the present invention, the bullet delivering pressure supplying means includes a pressure reducing valve which is installed on the bullet delivering pressure transferring tube connecting the air compressor with the shooting apparatus for reducing pressure of the compressed air distributed from the air compressor.

In accordance with the second aspect of the present invention, the bullet delivering pressure supplying means further includes at least one bullet delivering pressure adjusting valve which is installed between the pressure reducing valve and the shooting apparatus for adjusting reduced pressure of the compressed air.

In accordance with the second aspect of the present invention, the bullet delivering pressure supplying means further includes a low pressure controlling valve which is installed between the bullet delivering pressure adjusting valve and the shooting apparatus for supplying compressed air to a selected shooting apparatus.

In accordance with the second aspect of the present invention, the shooting game apparatus further comprises an air filter for filtering the compressed air so s to remove moisture or contaminant contained in the compressed air generated by the air compressor, wherein the air filter is installed inside a high pressure tube connecting the air compressor and the bullet shooting pressure supplying means.

In accordance with the third aspect of the present invention, there is provided a shooting game apparatus having a housing, an air compressor installed in the housing and at least one shooting apparatus for launching bullets using compressed air supplied from the air compressor, comprising: a pressure distributing valve which is connected to the air compressor and a high pressure tube for distributing compressed air generated by the air compressor bullet shooting pressure and bullet delivering pressure; a bullet shooting pressure adjusting valve which is installed on a bullet shooting pressure transferring tube connecting the pressure distributing valve with the shooting apparatus for adjusting the compressed air to be supplied to the shooting apparatus; a pressure reducing valve which is installed on a bullet delivering pressure transferring tube connecting the pressure distributing valve with the shooting apparatus for reducing pressure of the compressed air distributed by the pressure distributing valve; and a controller which is connected to the air compressor, the pressure distributing valve, the bullet shooting pressure adjusting valve, and the pressure reducing valve for controlling thereof.

In accordance with the third aspect of the present invention, the shooting game apparatus further comprises an auxiliary tank that is installed between the pressure distributing valve and the shooting apparatus for temporary storing compressed air distributed by the pressure distributing valve.

In accordance with the third aspect of the present invention, the shooting game apparatus further comprises at least one bullet delivering pressure adjusting valve which is installed between the pressure reducing valve and the shooting apparatus for adjusting reduced pressure of the compressed air by the pressure reducing valve.

In accordance with the third aspect of the present invention, the shooting game apparatus further comprises a low pressure controlling valve which is installed between the bullet delivering pressure adjusting valve and the shooting apparatus for supplying compressed air to a selected shooting apparatus.

In accordance with the third aspect of the present invention, the shooting game apparatus further comprises a moisture drying means that is installed at one end portion of a moisture discharging tube for drying moisture produced by the air compressor.

In accordance with the third aspect of the present invention, the shooting game apparatus further comprises an air filter for filtering the compressed air so as to remove moisture or contaminant contained in the compressed air generated by the air compressor, wherein the air filter is installed inside a high pressure tube connecting the air compressor and the pressure distributing valve.

In accordance with the fourth aspect of the present invention, there is provided a shooting game apparatus having a housing, an air compressor installed in the housing and at least one shooting apparatus for launching bullets using compressed air supplied from the air compressor, comprising: a pressure distributing valve which is connected to the air compressor and a high pressure tube for distributing compressed air generated by the air compressor to a bullet shooting pressure and a bullet delivering pressure; an air filter which is arranged inside the high pressure tube connecting the air compressor and the pressure distributing valve for removing contaminant or moisture contained in compressed air generated by the air compressor; a bullet shooting pressure adjusting valve which is installed on a bullet shooting pressure transferring tube connecting the pressure distributing valve with the shooting apparatus for adjusting the compressed air to be supplied to the shooting apparatus; an auxiliary tank which is installed between the pressure distributing valve and the shooting apparatus for temporary storing compressed air distributed by the pressure distributing valve; a pressure reducing valve which is installed on a bullet delivering pressure transferring tube connecting the pressure distributing valve with the shooting apparatus for reducing pressure of the compressed air distributed by the pressure distributing valve; a bullet delivering pressure adjusting valve which is installed between the pressure reducing valve and the shooting apparatus for adjusting pressure of compressed air, the pressure which is reduced by the pressure reducing valve; a low pressure controlling valve which is installed between the bullet delivering pressure adjusting valve and the shooting apparatus for supplying compressed air to a selected shooting apparatus; a moisture drying means which is installed at one end portion of a moisture discharging tube for drying moisture generated by the air compressor; and a controller which is electrically connected to the air compressor, the shooting apparatus, the pressure distributing valve, the bullet shooting pressure adjusting valve, and the pressure reducing valve, the bullet delivering pressure adjusting valve, and the low pressure controlling valve for controlling thereof.

In accordance with the fourth aspect of the present invention, the shooting game apparatus further comprises a bullet supplying apparatus.

In accordance with the fourth aspect of the present invention, the bullet supplying apparatus includes: a magazine having an outlet at bottom for storing bullets; a bullet delivering shaft which is installed under the magazine for delivering bullets outputted from the outlet; a driving means which is installed at one end of the bullet delivering shaft for rotating the bullet delivering shaft; a bullet delivering means for connecting the bullet delivering shaft with a shooting apparatus to deliver the bullets from the bullet delivering shaft to a shooting apparatus; and a compressed air supplying means for transferring the bullets to the shooting apparatus by providing the bullets with compressed air.

In accordance with the fourth aspect of the present invention, the bullet delivering shaft has spiral grooves on outer surface thereof.

In accordance with the fourth aspect of the present invention, the bullet supplying apparatus further includes a plate having a perpendicular hole thereon to communicate with the outlet of the magazine and a guide channel formed on a lower surface thereof to guide bullets, in which the plated is installed under the magazine.

In accordance with the fourth aspect of the present invention, the bullet supplying apparatus further includes a first supporting plate and a second supporting plate each of which is contacted with a light and a left side surfaces of the plate respectively, wherein the second supporting plate has a penetrating hole so that the bullets transferred along the spiral grooves can be to be passed out.

In accordance with the fourth aspect of the present invention, the guide channel is formed in such way that a part of normal size of the bullets can be inserted into the guide channel and distance between the guide channel and the spiral grooves must be greater than the normal size of the bullets, so that bullets smaller than the normal size bullet can be removed by being fallen down from the spiral grooves.

In accordance with the fourth aspect of the present invention, the bullet delivering means includes a fixing block in which a bullet delivering hole and a compressed air supplying hole are formed, the compressed air supplying hole being formed to communicate with the bullet delivering hole for supplying compressed air to the bullet delivering hole.

In accordance with the fourth aspect of the present invention, the compressed air supplying means includes an air compressor and a compressed air supplying tube that is connected to the air compressor for supplying the compressed air to the compressed air supplying tube.

In accordance with the fourth aspect of the present invention, the bullet delivering means is formed of a pipe member and connected to the front section of the spiral grooves at one end and the shooting apparatus at the other end, and the compressed air supplying means is connected to the pipe member.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE INVENTION

The invention may be better understood by a description of embodiments with reference to the attached drawings.

Figure 1:
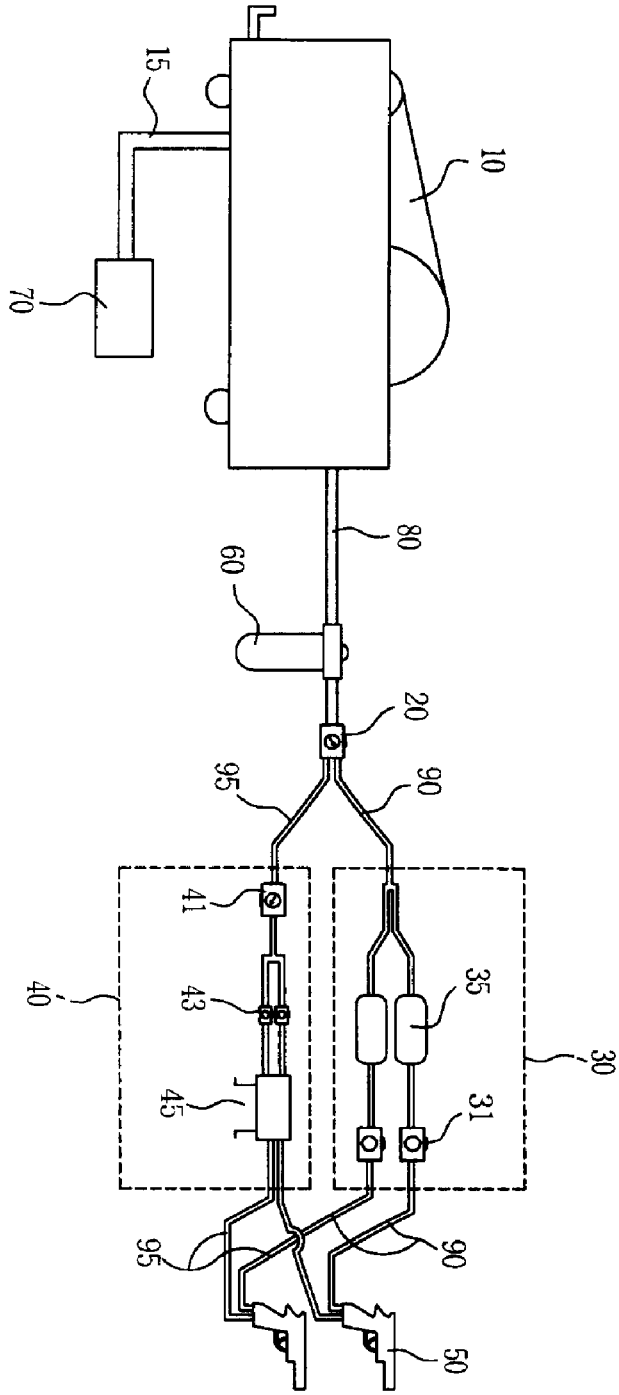
FIG. 1 is a schematic view of a shooting game apparatus in accordance with the present invention.

FIG. 1 is a schematic view of a shooting game apparatus in accordance with the present invention.

As shown in FIG. 1, a shooting game apparatus comprises a housing (not shown), a air compressor 10, at least one shooting apparatus 50 that shoots bullets using compressed air supplied from the air compressor 10, a bullet shooting pressure supplying means 30 that applies high pressured compressed air to the shooting apparatus 50 to shoot bullets, a bullet delivering pressure supplying means 40 that applies low pressured compressed air to bullets to deliver it to the shooting apparatus 50, pressure distributing valve 20 that is connected to the air compressor 10 and a high pressure pipe 80 and distributing compressed air generated by the air compressor 50 to the bullet shooting pressure supplying means 30 and the bullet delivering pressure supplying means 40, and a air filter 60 which is placed inside the high pressure pipe 80 to remove particles or contaminants and moisture contained in the compressed air.

The bullet shooting pressure supplying means 30 is installed on a bullet shooting pressure transferring tube 90 connecting the shooting apparatus 50 and the pressure distributing valve 20. Further the bullet shooting pressure supplying means 30 comprises a bullet shooting pressure adjusting valve 31 and a auxiliary tank 35 that is installed between the pressure distributing valve 20 and the shooting apparatus 50 to temporarily stores compressed air distributed by the pressure distributing valve 20.

The bullet delivering pressure supplying means 40 is installed on a bullet delivering pressure transferring tube 95 connecting the pressure distributing valve 20 and the shooting apparatus 50. The bullet delivering pressure supplying means 40 comprises a pressure reducing valve 41, at least one bullet delivering pressure adjusting valve 43 that is installed between the pressure reducing valve 41 and the shooting apparatus 50 to adjust reduced pressure of the compressed air, and low pressure controlling valve 45 that is installed between the bullet delivering pressure adjusting valve 43 and the shooting apparatus 50 to supply the compressed air to a selected shooting apparatus 50.

The air compressor 10, the shooting apparatus 50, the pressure distributing valve 20, the bullet shooting pressure adjusting valve 31, the pressure reducing valve 43, and the low pressure controlling valve 45 are controlled by a controller and electrically connected to the controller (not shown).

The operation principle of the shooting game apparatus described above will not be detailed below.

Compressed air generated by the air compressor 10 is passing through the air filter 60 and moisture and particles or contaminants contained the compressed air is removed during pasting through the air filter. After that dried and cleaned compressed air is distributed to the bullet shooting pressure transferring tube 90 and to the bullet delivering pressure transferring tube 95 by the pressure distributing valve 20.

The compressed air distributed to the bullet shooting pressure transferring tube 90 is temporarily stored into the auxiliary tank 35 and selectively supplied to one of the shooting apparatuses 50 by the bullet shooting pressure adjusting valve 31.

Pressure of the compressed air distributed to the bullet delivering pressure transferring tube 95 is reduced by the pressure reducing valve 41 and adjusted by the bullet delivering pressure adjusting valve 43. Number of the bullet delivering pressure adjusting valves 43 is the same as the number of the shooting apparatuses. Further, number of the bullet delivering pressure adjusting valves turned on is the same with the number of the shooting apparatus 50 being used. Accordingly, pressure supplied to the each of shooting apparatuses 50 from the bullet delivering pressure adjusting valves 43 is uniform by being adjusted by the low pressure controlling valve 45.

A bullet delivering tube is connected to the bullet delivering pressure transferring tube connecting the low pressure controlling valve 45 and the shooting apparatus 50, and bullets are delivered from a bullet delivering apparatus to the shooting apparatus 50 through the bullet delivering pressure transferring tube 95.

The shooting game apparatus in accordance with the present invention further includes a moisture drying means 70 to remove the moisture generated by the air compressor 10.

The moisture drying means 70 comprises a steal vessel that is connected to an end of a moisture discharging pipe 15 and a hot wire that is installed on bottom of the steal vessel, so that the moisture is discharged through the moisture discharging pipe 15. However, the moisture drying means 70 is not limited to the steal vessel with hot wire. A heating element or an element having exothermic reaction can be used as the moisture drying means 70 such as the steal vessel with hot wire.

Bullet Supplying Apparatus

The shooting game apparatus in accordance with the present invention further includes a bullet supplying apparatus that is connected or secured to the bullet delivering pressure transferring tube 95 to supply bullets to the shooting apparatus 50.

Figure 2:
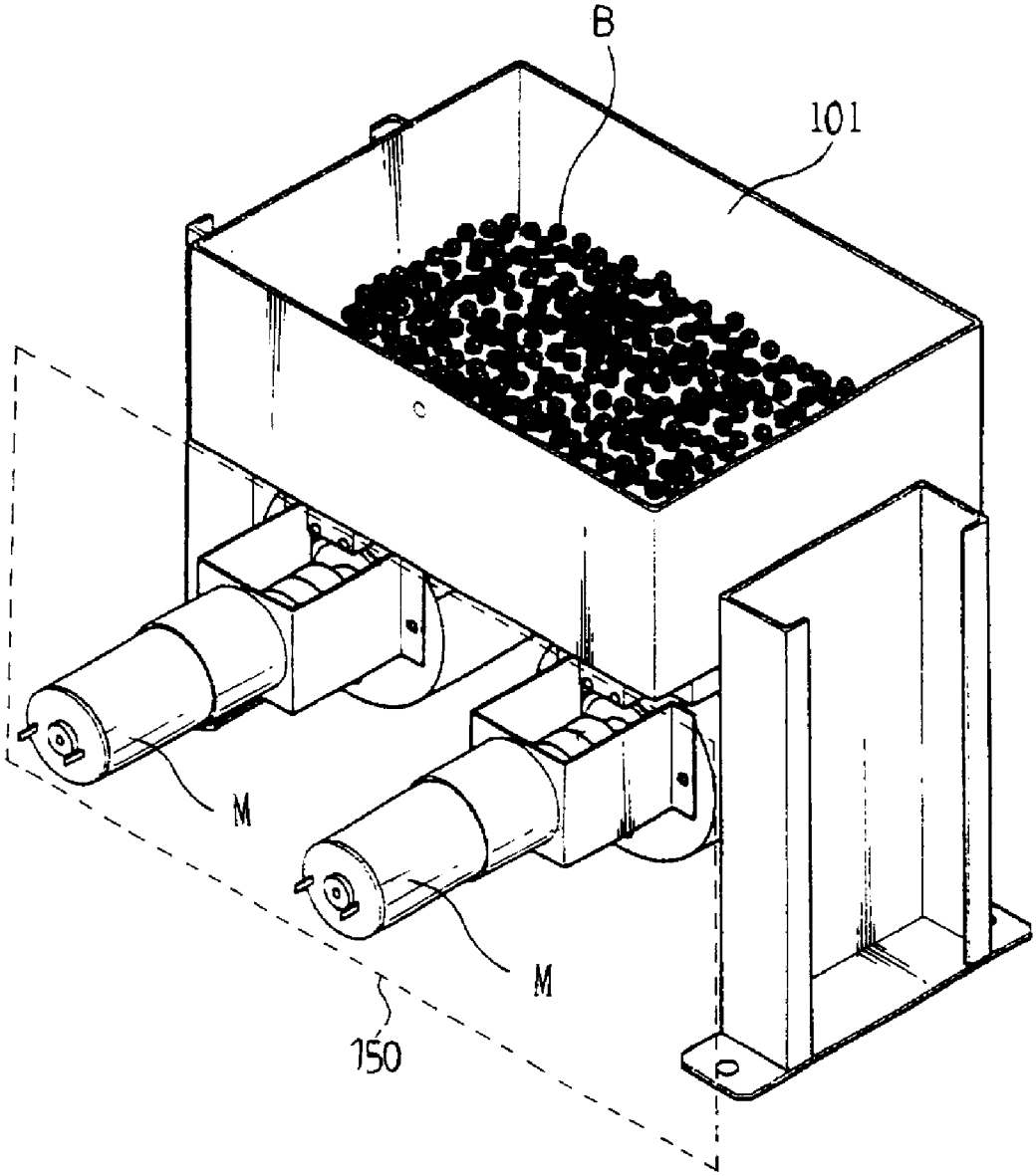
FIG. 2 is a perspective view of a shooting game apparatus in accordance with the present invention.

FIG. 2 is a perspective view of the bullet supplying apparatus in accordance with the present invention. The bullet supplying apparatus comprises rectangular parallelopiped shape of a magazine 101 for storing bullets B and a bullet delivering section 150. The elements indicated by numerical numbers are supporting plate that are used to support the magazine 101.

The magazine 101 has an outlet 101*a* at the center of the bottom of the magazine 101, so that the bullets B in the magazine 101 can be outputted from the magazine 101 toward the bullet delivering section 150 through the outlet 101*a*.

Figure 3:
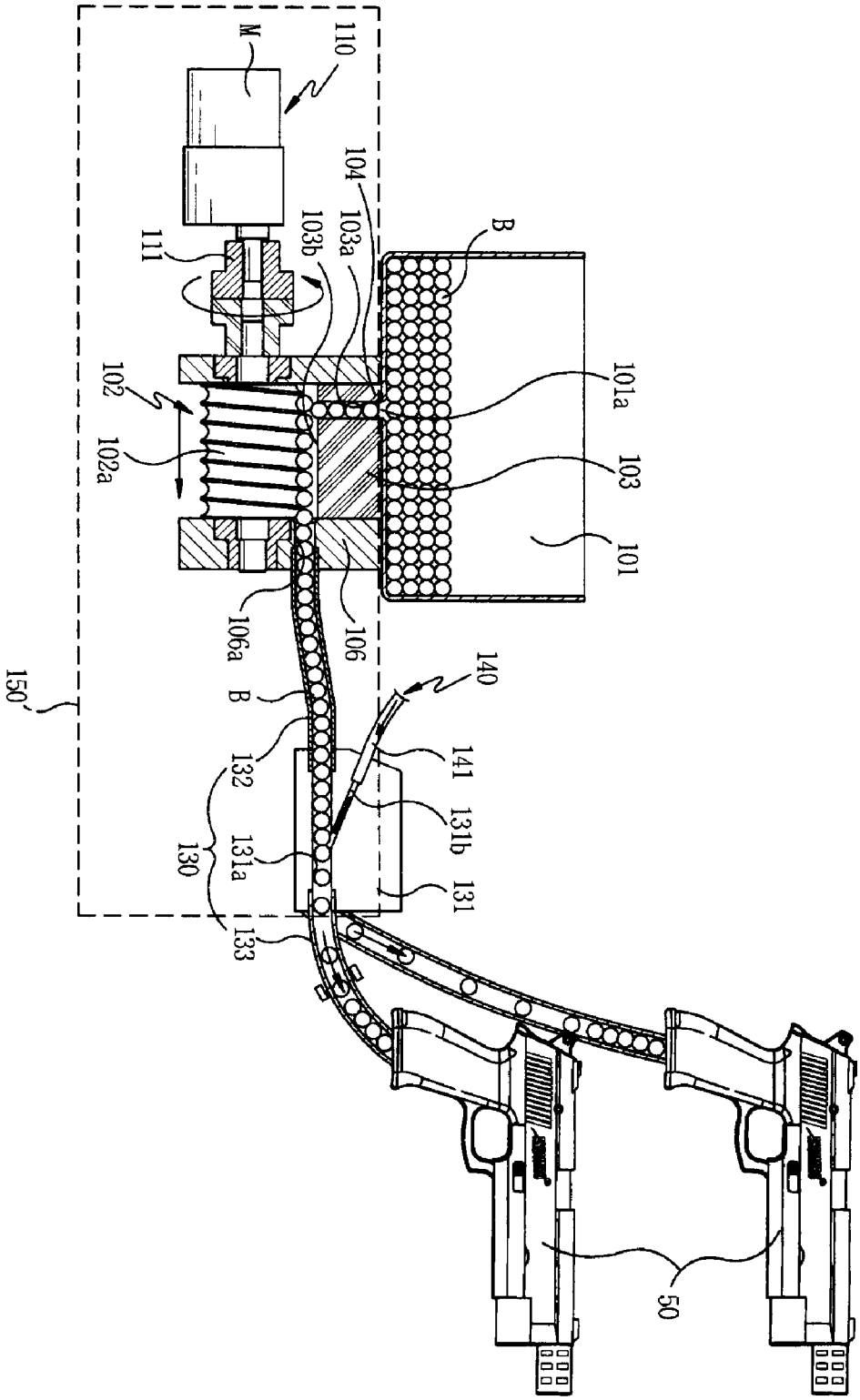
FIG. 3 is a front view showing configuration and operation of a shooting game apparatus in accordance with the present invention.

The bullet delivering section 150 is attached at lower surface of the magazine 101. FIG. 3 shows the bullet delivering section 150 in detail. The bullet delivering section 150 comprises a plate 103 having a perpendicular hole 103*a* formed to penetrate the plate 103 and a guide channel 103*b* formed at a lower surface thereof and connected to one end of the perpendicular hole 103*a*, a bullet delivering shaft 102 placed under the plate 103, a driving means 110 which is connected to an end of the bullet delivering shaft 102 for rotating the bullet delivering shaft 102, a bullet delivering means 130 for delivering bullets B compulsorily delivered by the bullet delivering shaft 102 toward a shooting apparatus 50, and a compressed air supplying means 140 for supplying compressed air to push the bullets toward the shooting apparatus 50.

The plate 103 is placed between the magazine 101 and the bullet delivering shaft 102 for providing a path through which bullets B can be passed from the magazine 101 to the bullet delivering shaft 120. The perpendicular hole 103 is a barrel through which the bullets B are capable of free falling.

The perpendicular hole 103*a* is communicated with the outlet 101*a* of the magazine 101. Therefore, bullets B can be moved along the perpendicular hole 103*a* and a guide channel 103*b*.

The bullet delivering shaft 102 has spiral grooves 102*a* on outer surface thereof and along which bullets can be passed.

The driving means 110 comprises a motor M and a coupling 111 connecting the motor M and the bullet delivering shaft 102, so that the bullet delivering shaft 102 is rotated by the motor M.

A first and second supporting plates 104,106 are attached to each side of the plate 103 to secure it to the bullet delivering shaft 102. Further, the magazine 101 and the bullet delivering section 150 are fixed each other using the supporting plates 104, 106. The second supporting plate 106 has a penetrating hole 106*a* through which bullets B passed through the guide channel 103*b* and spiral grooves 102*a* can be outputted outside the bullet delivering shaft 102.

Further, the bullet delivering means 130 is a path for delivering bullets B from the second supporting plate 106 to the shooting apparatus 50. The bullet delivering means 130 comprises a fixing block having a bullet delivering hole 131*a* through which the bullets B can be passed and a compressed air supplying hole 131*b* which is connected to the compressed air supplying means 140, a first bullet delivering tube 132 which is connected to the penetrating hole 106 at one end and to the bullet delivering hole 131*a* at the other end, and a second bullet delivering tube 133 which is connected to the bullet delivering hole 131*a* at one end and to the shooting apparatus 50 at the other end.

Accordingly, the bullets B is passed along the spiral grooves 102*a*, through the penetrating hole 106*a* formed on the second supporting plate 106, the first bullet delivering tube 132, the bullet delivering hole 131*a* formed in the fixing block and the second bullet delivering tube 133 to the shooting apparatus 50.

The compressed air supplying means 140 comprises an air compressor (referring to an element indicated by numerical number 10 in FIG. 1) which supplies compressed air and a air supplying tube 141 which is connected to the air compressor and supplies the compressed air to the compressed air supplying hole 131*b*. Accordingly, the compressed air is supplied to the bullet delivering hole 131*a* and delivers the bullets B to the shooting apparatus 50. More specifically, the compressed air supplying means 140 corresponds to the bullet delivering pressure transferring tube 95.

It is preferable to form the magazine 101 to have a bottom tapered toward a center portion, so that the bullets B is easily and continuously supplied through the outlet 101*a* to the bullet delivering section 150.

The operation of the bullet supplying apparatus will be detailed below.

Figure 4A:
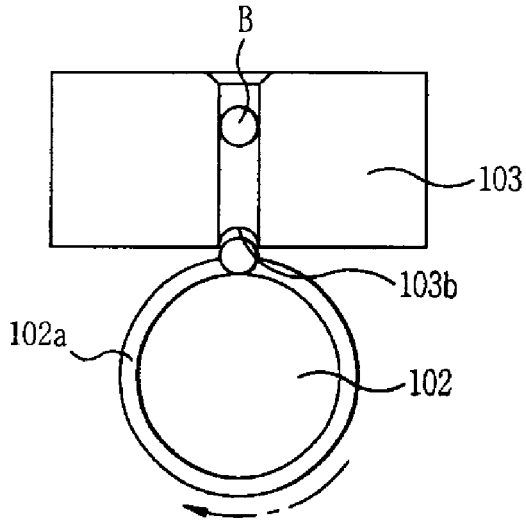
FIGS. 4*a* through 4*c* are cross-sectional side views showing a sorting work of abnormal bullets and contaminants from a bullet transferring shaft.
Figure 4B:
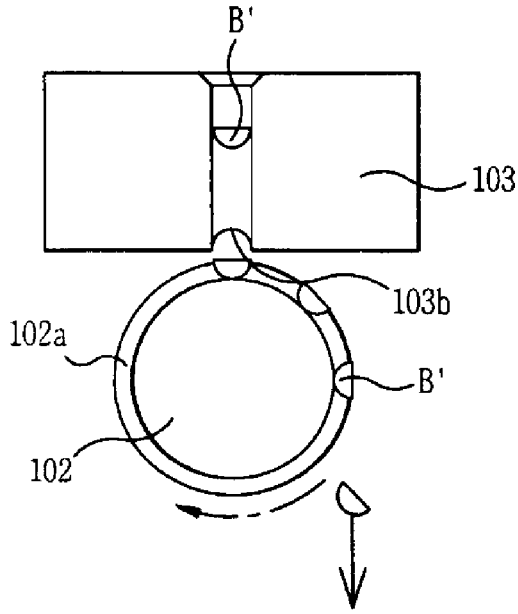
Figure 4C:
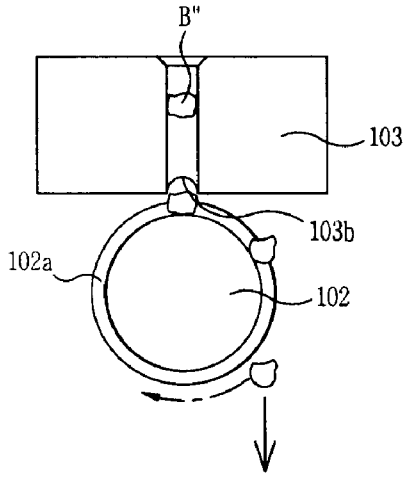

First, the bullets B stored in the magazine 101 is continuously passed through the outlet 101*a* formed on bottom of the magazine 101 and the perpendicular hole 103*a*, and inserted into the spiral grooves 102*a* of the bullet delivering shaft 102 after free falling in the perpendicular hole 103*a*. The bullet delivering shaft 120 is continuously rotated because the bullet delivering shaft 120 is connected to the motor M. Accordingly, bullets inserted into the spiral grooves 102*a* are moved along the guide channel 103*b* toward the bullet delivering means 130. The bullets B are vibrated due to rotation of the bullet delivering shaft 102 and rolled due to friction with the surface wall of the spiral grooves 102*a*. Thus, as shown in FIG. 4*a* through FIG. 4*c*, abnormal bullets B', B" having distorted shapes which are formed by being broken, smashed, or cracked will be fallen down toward the underneath before reaching to the right end of the bullet delivering shaft 102. Accordingly, only normal bullets having standardized shapes and sizes are reached to the bullet delivering means 130.

After that, the normal bullets B are passed through the penetrating hole 106*a* and the first bullet delivering tube 103 communicated with the penetrating hole 106*a*.

The bullets B are continuously supplied from the magazine 101 to the bullet delivering shaft 102 by the gravity and sorted by the bullet delivering shaft 102 which is continuously being rotated by the driving means 110, so that the sorted normal bullets are compulsorily delivered to the fixing block 131. A bullet delivering force from the magazine 101 to the penetrating hole 106*a* is rotary power of the motor M. However a bullet delivering force from the fixing block 131 to the shooting apparatus 50 is pressure of the compressed air.

That is, the compressed air supplying means 140 is installed at about center portion of the bullet delivering means 130, so that the bullets are compulsorily delivered from the bullet supplying apparatus to the center portion between the bullet supplying apparatus 101 and the shooting apparatus 50 by means of rotary power of the motor M, and after that bullets B are delivered from the center portion to the shooting apparatus 50 by means of the compressed air. Accordingly, the motor M is not overloaded due to aid of the compressed air, and delivering time of the bullets are reduced.

Further, the bullet delivering means 130 can be made of a tube member connected to the compressed air supplying means at a center portion thereof.

FIGS. 4*a* through 4*c* are cross-sectional side views showing a sorting work of abnormal bullets and contaminants from a bullet transferring shaft. As shown in FIG. 4*a*, normal bullets B can be moved along the guide channel 103*b*. However, as shown in FIGS. 4*b* and 4*c*, abnormal bullets B', B", or contaminants are fallen down to the underneath. The same numeral shown in FIGS. 4*a* through 4*c* and FIG. 3 indicates same elements.

Bullet Sorting Apparatus

The shooting game apparatus in accordance with the present invention includes a bullet sorting apparatus for sorting and removing abnormal bullets before the bullets are supplied to the bullet supplying apparatus described above.

Figure 5:
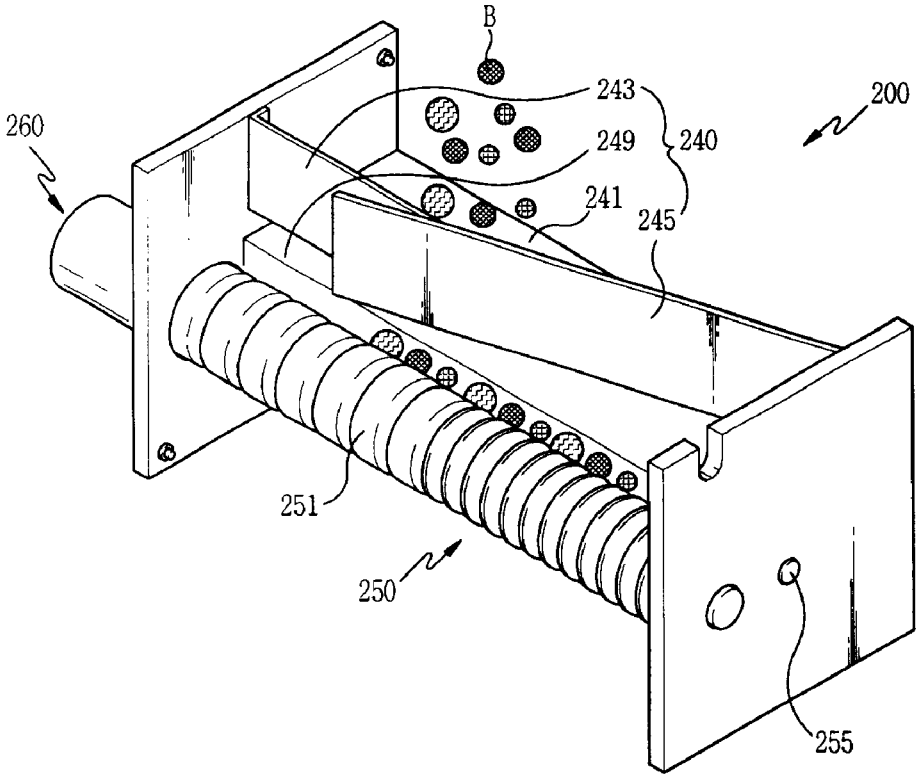
FIG. 5 is a perspective view of a bullet sorting apparatus in accordance with the present invention.

FIG. 5 is a perspective view of the bullet sorting apparatus in accordance with the present invention. The bullet sorting apparatus 200 comprises a bullet line-up apparatus 240 for lining up and receiving bullets B shot from the shooting apparatus (not shown), a bullet selecting means 250 and a driving means 260.

The bullet line-up apparatus 240 includes a base plate 241, a line-up plate 243 and a guide plate 245. The base plate 241 is downward sloped toward the front so that the bullets B can be rolled to the front and inclined sidewall. The base plate 241 collects the bullets B delivered by means of a conveyor belt. The line-up plate 243 is perpendicularly installed on the base plate 241 in front of the base plate 241. The guide plate 245 is contacted with one end of the line-up plate 243 and perpendicularly installed on the base plate 241 for guiding the bullets B to the front.

The line-up plate 243 is separated from the base plate 241 at a distance greater than diameter of the bullets B.

The bullets B are rolled over to the front by the gravity because the base plate 241 is formed downwardly sloped toward the front, lined up in a row between the base plate 241 and the line-up plate 243 and then supplied to the bullet selecting means 250.

The bullet selecting means 250 is arranged in parallel with the bullets B lined up by the base plate 241 and the line-up plate 243. The bullet selecting means 250 includes a first selecting bar 251 having spiral grooves on outer surface thereof and a second selecting bar 255 of a barrel shape which is arranged to be separated from the first selecting bar 251 at a distance of diameter of bullets B.

The bullet selecting means 250 can separate the bullets into three groups of normal bullets, big bullets greater than the normal bullets, and small bullets smaller than the normal bullets.

Figure 6:
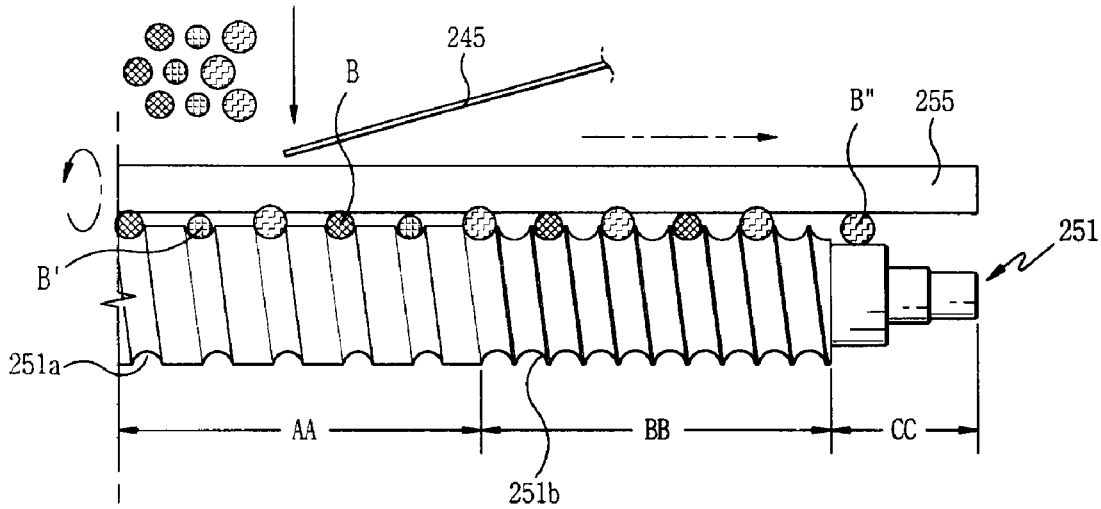
FIG. 6 is a plan view of a bullet sorting apparatus in accordance with the present invention.

That is, the first selecting bar 251 as shown in FIG. 6 is comprised three zones of first to third zones AA, BB, CC depending on the depth of the spiral grooves 251*a*. The first zone AA is arranged to select the broken or cracked small bullets B' that has a size smaller than the normal size. The second zone BB is arranged to select the normal size of bullets B, and the third zone CC is arranged to select particles or contaminants or the big bullets B" formed by being distorted.

In the first zone AA, distance between center portion of the spiral grooves 251*a* formed in the first selecting bar 251 and the second selecting bar 255 is less than the diameter of the normal bullets B. All bullets B, B', B" received by the base plate 241 will be firstly supplied to the first zone AA by being guided by the guide plate 245. Accordingly, the normal bullets B or the big bullets B" are moved to the second zone BB along the spiral grooves 251*a* but the broken or cracked small bullets B' are fallen down toward the underneath through a space between the grooves 251*a* and the second selecting bar 255.

On the other hand, in the second zone BB, the first selecting bar 251 has spiral grooves 251*b* having a depth greater than that of the spiral grooves 251*a*. Thus, a distance between a center portion of the spiral grooves 251*b* in the second zone BB and the second selecting bar is slightly greater than diameter of the normal bullets B. Accordingly, normal bullets B are fallen down toward the underneath in the second zone BB and only big bullets B" are moved to the second zone CC. In the second zone BB, only normal size of bullets B have to be fallen down. Accordingly, the distance between a center portion of the spiral grooves 251*b* in the second zone BB and the second selecting bar have to be accurately designed. For example, diameter of the normal size bullets is 5.9–6 mm, so that the distance must be slightly greater than 6 mm but common difference could not be great.

The third zone CC is arranged to select distorted big bullets. Accordingly in the third zone CC, the first selecting bar 251 has spiral grooves 251*c* having a depth greater than that of the spiral grooves 251*b* in the second zone BB. Thus, a distance between a center portion of the spiral grooves 251*c* and the second selecting bar is greater than the distance in the second zone BB.

The bullets fallen down in each zone AA, BB, CC must be separately collected, so that boxes are placed under the bullet sorting apparatus 200 in each zone. Further, it is preferable to install a bullet collecting section (not shown) under the second zone BB to supply the collected normal bullets to the shooting apparatus.

The bullet collecting section can be a box or a tray.

The operation of the bullet sorting apparatus 200 will be detailed below.

In case a gamer shoots bullets, shot bullets B from the shooting apparatus are delivered to the bullet sorting apparatus 200 by means of a conveyor belt which is installed under the shooting apparatus, and then the bullets are free fallen to the base plate 241 of the bullet sorting apparatus 200.

Figure 7A:
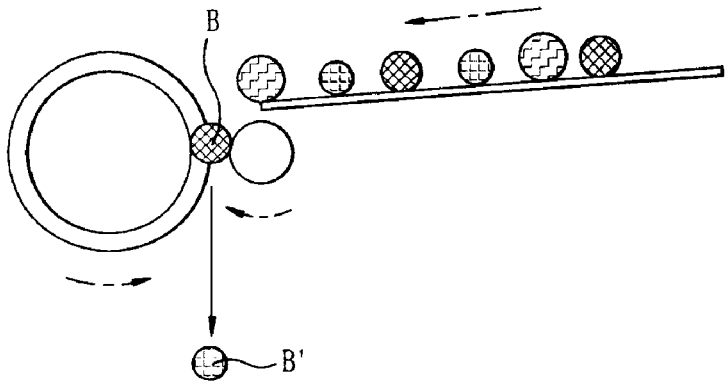
FIG. 7*a* is a side view of a bullet sorting apparatus in accordance with the present invention, in which the view is showing a sorting operation to remove abnormal bullets.
Figure 7B:
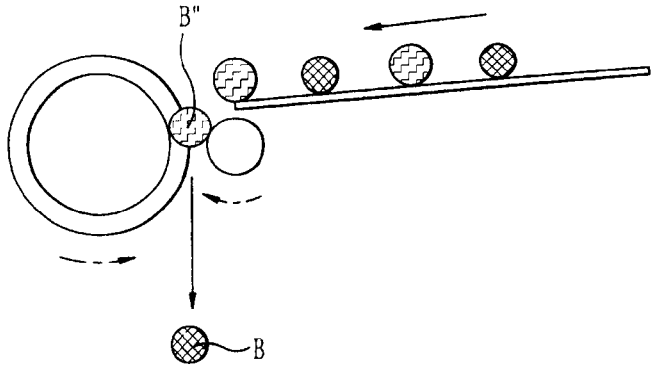
FIG. 7*b* is a side view of a bullet sorting apparatus in accordance with the present invention, in which the view is showing a sorting operation to select normal bullets.

The bullets B are rolled over to the line up plate 243 in front of the base plate 241 along the downwardly sloped bottom and supplied to the first zone AA. Then the bullets are moved to the second zone BB along the spiral grooves 251*a* in response to rotating operation of the first selecting bar 251 which is rotated by the driving means 260. The second selecting bar 255 is also rotated contacting with the bullets B inserted into the spiral grooves 251*a*. At this time, as shown in FIG. 7*a*, the small bullets B' are fallen down in the first zone AA and normal bullets B or big bullets B" are moved to the second zone BB along the spiral grooves 251*a*. Then, as shown in FIG. 7*b*, bullets B, B" are inserted into the spiral grooves 251*b* and normal bullets B is fallen down in second zone BB and big bullets B" is moved to the third zone CC along the spiral grooves 251*b*. The normal bullets B fallen down in second zone BB is collected in the bullet collecting section (not shown) and supplied to the bullet supplying apparatus for supplying the bullets to the shooting apparatus.

In the preferred embodiment of the present invention, the bullet selecting zones are divided by three but the present invention is not limited to the preferred embodiment, and further can be modified, changed and varied in many different ways.

Motor Overload Prevention Apparatus

The shooting game apparatus in accordance with the present invention includes a motor overload prevention apparatus that is capable of protecting a motor from being damaged when the motor can not be rotated because particles or contaminants are caught in a space between the first selecting bar 251 and the second selecting bar 255 of the bullet sorting apparatus 200.

Figure 8:
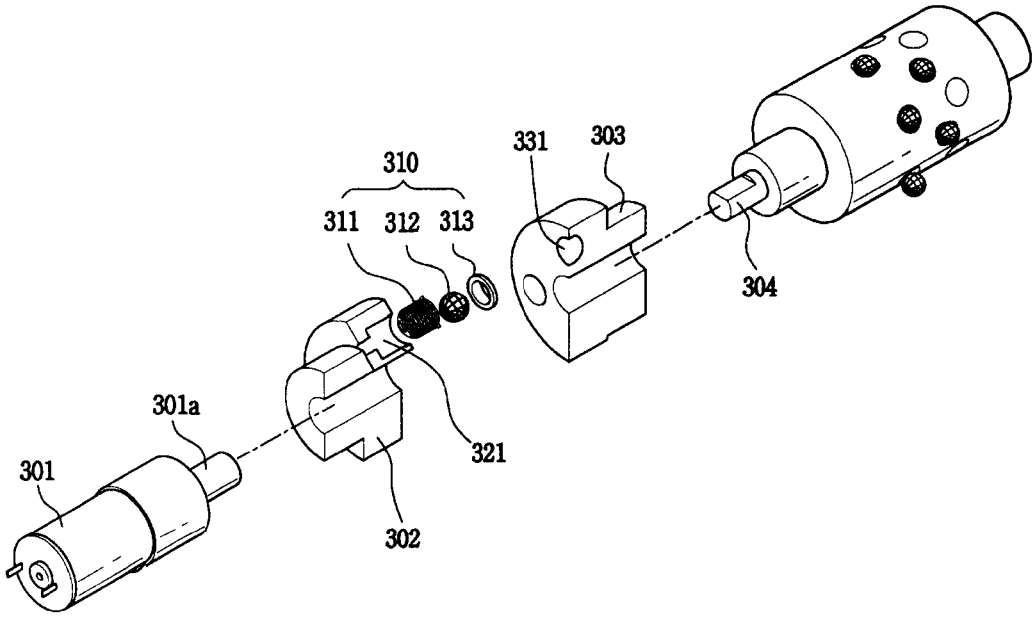
FIG. 8 is an exploded perspective view of a motor overload prevention apparatus in accordance with the present invention.

FIG. 8 is a perspective view of the motor overload prevention apparatus. The motor overload prevention apparatus comprises a first coupling 301*a* installed on a driving shaft 301*a* which transfers rotary power of the motor, a second coupling 303 installed on a outputting shaft 304, power transferring means 310 for transferring rotary power from the first coupling 302 to the second coupling 303.

The first coupling 302 has an inserting hole 321 at front section, so that the power transferring means 310 is installed into the inserting hole 321 to be moved backwardly and forwardly.

The power transferring means 310 includes an elastic member 311 which is inserted into the inserting hole 321 and a ball 312 which is placed at the elastic member 311 and moved backward and forward.

The second coupling 303 has a ball inserting hole 331 at side surface with which is contacted with the first coupling 302.

The first coupling 302 has a plurality of the inserting holes 321, for example four (4) inserting holes, at the front section, wherein each of the inserting holes 321 are formed in radiation type.

The elastic member 311 is a typical spring. A compressed coil spring is used as the elastic member 311 in the preferred embodiment of the present invention.

The inserting holes 321 must be formed to have an entrance portion smaller than diameter of the ball 312, so that the ball 312 and the elastic member 311 not to be separated from the inserting holes 321. In the preferred embodiment of the present invention, a ring which has an inside diameter smaller than the diameter of the ball 312 is fixed at the entrance portion of the inserting holes 321. Thus, the inserting holes 321 have the entrance portion smaller than the diameter of the ball 312. However, other known various ways to reduce the entrance size of the inserting holes can be applied.

However, it is preferable that the inside diameter of the ring 313 is just slightly smaller than the diameter of the ball 312. Thus, a part of the ball 312 can be exposed outside when the ball 312 is placed into the inserting holes 321.

Further it is preferable that thickness of the ring 313 must be thin enough and side surface of the ring 313 be even. Further, the inserting holes 321 have a placing trench at the side surface. Depth of the placing trench is the same as the thickness of the ring 313, so that the side surface of the first coupling 302 can be even after being placed the ring 313 into the placing trench.

As for the ring used to reduce the entrance size of the inserting holes 321, the present invention is not limited to the ring. A bolt or other connection means can be used instead of the ring.

As the power transferring means 310, the ball 312 is placed at the elastic member 311 and exposed to outside the first coupling 302. Further, a part of the ball 312 is inserted into the ball inserting holes 331 of the second coupling 303. At that condition, the first coupling 302 and the second coupling 303 are connected to each other and rotary power of the motor can be transferred to the second coupling 303. If an external force is applied to the second coupling 303, the elastic member 311 is compressed by the ball 312 and completely inserted inside the inserting holes 321.

Accordingly, mechanical properties of the elastic member 311 such as elasticity limits, fatigue limits, hardness are very important.

The operation of the motor overload prevention apparatus in accordance with the present invention will be detailed below.

Figure 9A:
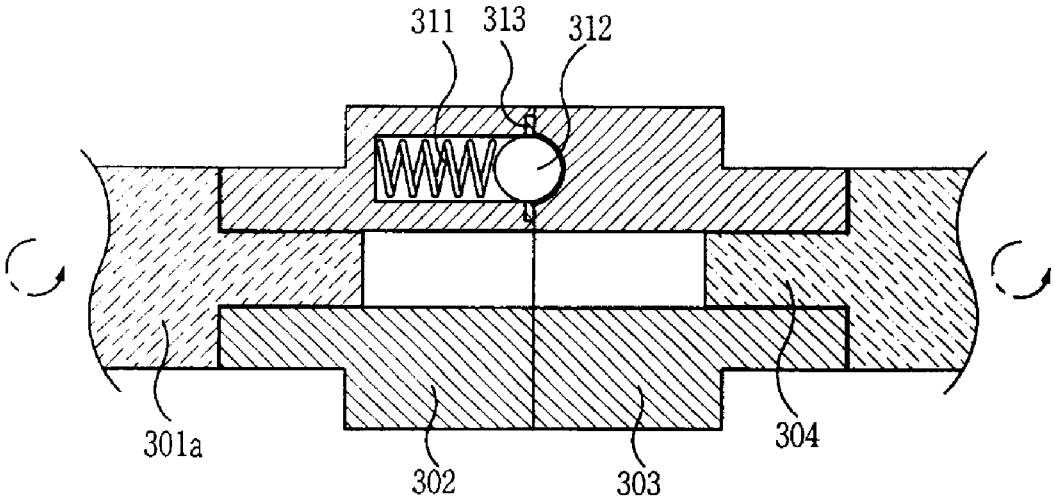
FIG. 9*a* is a cross-sectional view showing a connective section between a first coupling and a second coupling.
Figure 9B:
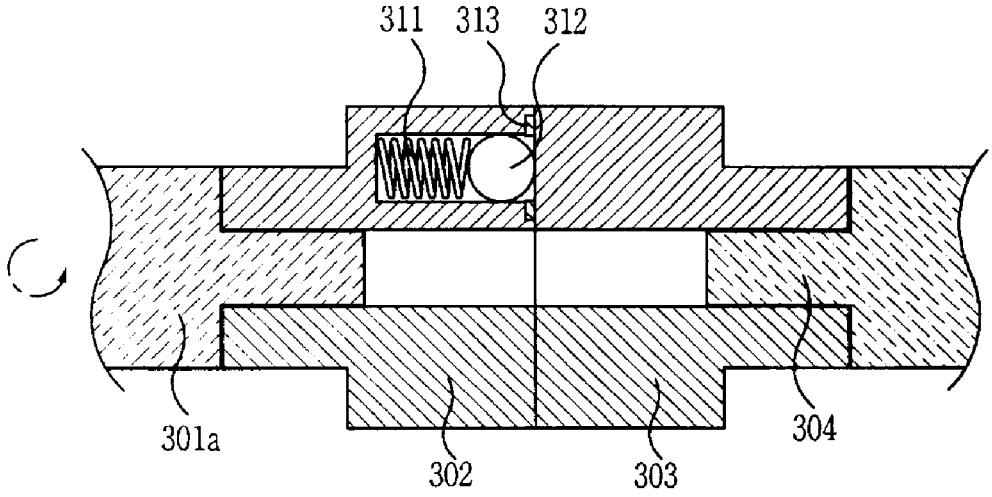
FIG. 9*b* is a cross-sectional view showing a first coupling that is being rotating.

FIG. 9*a* is a cross-sectional view of the motor overload prevention apparatus wherein the first coupling 302 and the second coupling 303 are combined with each other. FIG. 9*b* shows a status that only the first coupling 302 is being rotated.

As shown in FIGS. 9*a* and 9*b*, the driving shaft 301*a* to be rotated by the motor 301 is installed into the first coupling 302 and the first coupling 302 and the second coupling 303 are combined, so that the ball 312 is being elastically supported by the elastic member 311 and inserted into the inserting holes 331 of the second coupling 303. After that, the motor is rotated. During the motor is rotated, the ball 312 transfers the rotary power of the first coupling 302 to the second coupling 303, so that the first coupling 302 and the second coupling 303 can be rotated together and the outputting shaft 304 which is combined with the second coupling 303 is also rotated.

However, if an external force is applied to the second coupling 303, the second coupling 303 stopped rotating but the first coupling 302 is still rotating because the motor coupled to the first coupling 302 is continuously rotating. At this time, the ball 312 inserted into the inserting hole 331 and the first coupling 302 is rotating together. Accordingly, if the second coupling 303 stopped rotating, the ball 312 is still rolling and being pushed toward the elastic member 311, so that the ball 312 is separated from the inserting hole 331 of the second coupling 303 and completely inserted into the inserting holes 321 of the first coupling 302 as shown in FIG. 9*b*. Accordingly, connection of the first coupling 302 and the second coupling 303 is released, so that the first coupling 302 can be continuously rotated regardless of the second coupling 303. Therefore, the motor is can be free from overload and damage.

Shooting Apparatus

Figure 10:
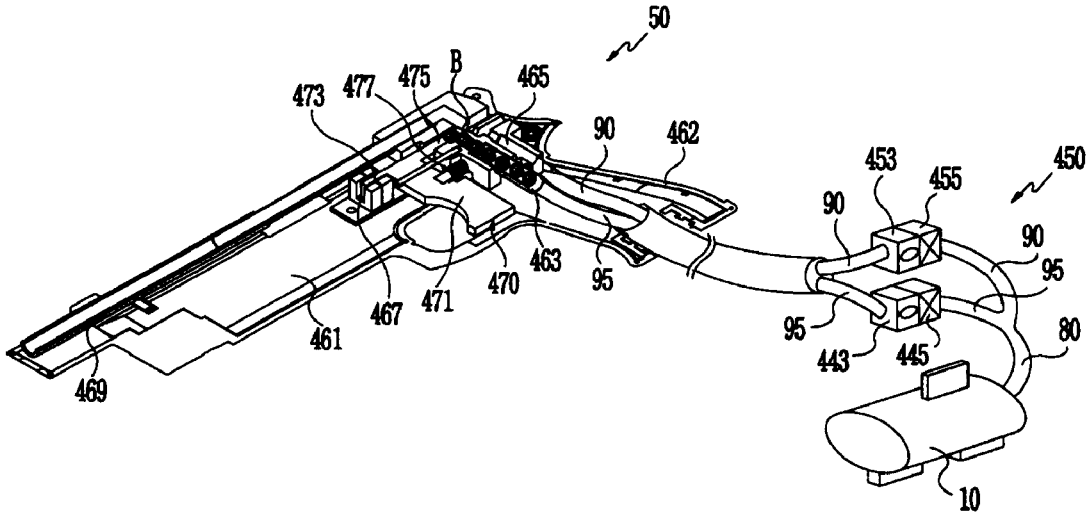
FIG. 10 is an inside configuration of a bullet shooting apparatus before a trigger is pulled.
Figure 11:
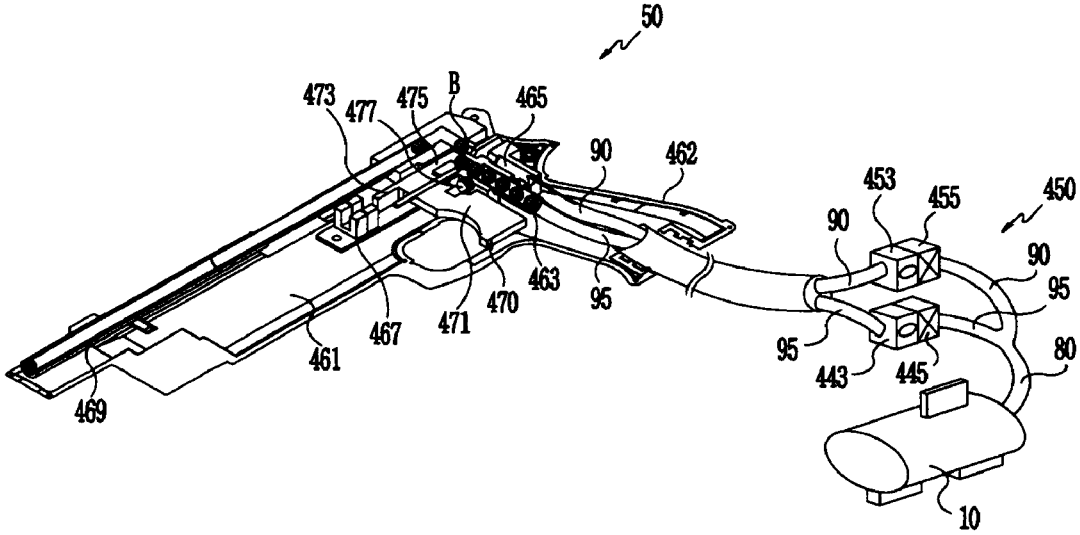
FIG. 11 is an inside configuration of a bullet shooting apparatus after a trigger is pulled.

FIG. 10 and FIG. 11 show inside configuration of the shooting apparatus in which a trigger is not pulled in FIG. 10 but pulled in FIG. 11.

The shooting apparatus or air gun 50 in accordance with the present invention is connected to a compressed air supplying means 450. The compressed air supplying means 450 includes a air compressor 10, high pressure pipe 80, on/off valves 445, 455, pressure adjusting valves 443, 445, a bullet shooting pressure transferring tube 90 and a bullet delivering pressure transferring tube 95. The pressure adjusting valve 443 connected to the bullet shooting pressure transferring tube 90 corresponds to the bullet shooting pressure supplying means 30 shown in FIG. 1. The pressure adjusting valve 445 connected to the bullet delivering pressure transferring tube 95 corresponds to the bullet delivering pressure supplying means 40 shown in FIG. 1. Therefore, the compressed air supplying means 450 is the same as the configuration shown in FIG. 1 except on/off valves 445, 455. That is, the compressed air supplying means 450 added on/off valves 445, 455 to the configuration of FIG. 1.

Now, shooting apparatus or air gun 50 will be detailed. The shooting apparatus 50 includes a main body 461, a bullet magazine 463 which is connected to the bullet delivering pressure transferring tube 95 for charging bullets B, a bullet shooting tube 465 which is connected to the bullet shooting pressure transferring tube 90, a trigger 470 for moving the bullets B charged into the bullet magazine 463 to the bullet shooting tube 465 and a sensor 467 which controls opening and closing of on/off valve 455 by detecting movement of the trigger 470 using the controller (not shown).

The trigger 470 includes a body 471, a sensing part 473 which is inserted into the sensor 467 and protruded from the front of the body 471, a pushing part 475 which is protruded from the back of the body 471 for moving the bullets B charged into the bullet magazine 463 to bullet shooting tube 465, and an elastic member 477 such as a spring which is placed between the body 471 of the trigger 470 and the main body 461 of the air gun 50 for providing restoration.

Operation and effects of the shooting apparatus in accordance with the present invention will be detailed below.

First, a gamer places the shooting apparatus 50 into an inserting hole of a game box and pulls a trigger 470. The sensing part 473 slips from the sensor 467 and the sensor 467 detects that the trigger 470 is pulled, so that the sensor 467 transfers a detecting signal to the controller (not shown) and the detecting signal opens the on/off valve 455. At the same time, the pushing part 475 pushes the bullets B charged in the bullet magazine 463 to the bullet shooting tube 465, and the bullets 465 is shot from the shooting apparatus 50 by means of high pressured compressed air supplied through the bullet shooting pressure transferring tube 90.

In case the gamer releases the trigger 470, the sensing part 473 is inserted into the sensor 467 and the sensor 467 detects movement of the trigger 470 and transfers a detecting signal to the controller. The detecting signal closes the on/off valve 455. At the same time, the pushing part 475 moves toward a side of the bullet magazine 463 from the bullet shooting tube 465 and the bullets B is being pushed up by means of low pressured compressed air supplied through the bullet delivering pressure transferring tube 95, so that the bullets will be in stand-by place for launching. The on/off valve 445 is constantly opened in the middle of game and closed during the shooting game apparatus is being repaired or replaced.

The bullets B are directed to a target by means of the high pressured compressed air which is supplied from the air compressor 10. If the bullets B hit the target of a holder behind a game box (not shown), a premium hanging on the target dropped to the underneath, so that the premium is provided to a gamer along a conveyor installed under the game box.

The present invention is not limited to the preferred embodiment of the present invention described above, and the preferred embodiment is just exemplary depicted.

The shooting game apparatus in accordance with the present invention includes an auxiliary tank 35 which temporary stores the compressed air distributed from the pressure distribution valve 20 which is installed at the front of the bullet shooting pressure adjusting valve 31 on the bullet shooting pressure transferring tube 90, so that the uniform shooting pressure is constantly applied to each of the shooting apparatus 50 even if the air compressor 10 is malfunctioned or air is leaked from the high pressure pipe 80. Accordingly, the shooting game apparatus in accordance with the present invention is capable of providing a gamer with game performance reliability by keeping uniform bullet shooting velocity.

Further, the shooting game apparatus in accordance with the present invention includes a moisture drying means installed at one end of a moisture discharging pipe 15 for drying the compressed air. Thus, compartments of shooting game apparatus are prevented from being rusted or contaminated, and maintenance or repair cost will be reduced because there is no need to drain the water from the shooting game apparatus.

Further, the shooting game apparatus in accordance with the present invention includes a bullet supplying apparatus which is capable of selecting and supplying only normal size of bullets to the shooting apparatus, so that it is prevented the compressed air from being leaked or the game apparatus from being stopped due to the abnormal bullets.

Further, the shooting game apparatus in accordance with the present invention is capable of reducing load of a motor or an air compressor because low pressured compressed air is used to deliver the bullets to a shooting apparatus.

Further, the shooting game apparatus in accordance with the present invention is trouble free due to its simple structure.

Further, the shooting game apparatus in accordance with the present invention is capable of stably supplying bullets to a shooting apparatus.

Further, the shooting game apparatus in accordance with the present invention can be easily assembled due to its simple structure. Therefore manufacturing cost can be reduced and reliability of the apparatus can be raised.

Further, the shooting game apparatus in accordance with the present invention includes a bullet sorting apparatus that is capable of removing abnormal or damaged bullets that have size smaller or bigger than the normal size. Therefore troubles caused by the abnormal bullets can be reduced.

Further, the shooting game apparatus in accordance with the present invention includes a motor overload prevention apparatus that is capable of smoothly transferring rotating force of a motor to a rotating shaft and protecting a motor from being damaged by suppressing overload of the motor when a motor is not rotated.

Further, for the shooting game apparatus in accordance with the present invention, a spool, a solenoid valve for operating the spool, and a compressed air transferring tube for transferring compressed air to the solenoid valve are not needed, so that the shooting game apparatus can be simplified and easily assembled. Further troubles caused by careless of the gamers or bombardments can be reduced and reliability of the apparatus can be raised.

What is claimed is:

1. A shooting game apparatus having a housing, an air compressor installed in the housing, and at least one shooting apparatus for shooting a bullet using compressed air supplied from the air compressor, comprising:

a bullet shooting pressure supplying means for supplying relatively high pressure using compressed air generated by the air compressor to the shooting apparatus so as to shoot a bullet;

a bullet delivering pressure supplying means for supplying relatively low pressure using compressed air generated by the air compressor to deliver a bullet to the shooting apparatus; and a controller which is electrically connected to the air compressor, the shooting apparatus, the bullet shooting pressure supplying means and the bullet delivering pressure supplying means for controlling thereof;

a bullet supplying apparatus wherein the bullet supplying apparatus includes:

a magazine having an outlet at bottom for storing bullets;

a bullet delivering shaft which is installed under the magazine for delivering bullets outputted from the outlet;

a driving means which is installed at one end of the bullet delivering shaft for rotating the bullet delivering shaft wherein the bullet delivering shaft has spiral grooves on outer surface thereof;

a bullet delivering means for connecting the bullet delivering shaft with a shooting apparatus to deliver the bullets from the bullet delivering shaft to a shooting apparatus; and a compressed air supplying means for transferring the bullets to the shooting apparatus by providing the bullets with compressed air;

a plate having a perpendicular hole thereon to communicate with the outlet of the magazine and a guide channel formed on a lower surface thereof to guide bullets, in which the plate is installed under the magazine, wherein the guide channel is formed in such way that a part of a normal size bullet can be inserted into the guide channel and distance between the guide channel and the spiral grooves must be greater than a normal size bullet, so that bullets smaller than the normal size bullet can be removed by being fallen down from the spiral grooves;

a first supporting plate and a second supporting plate each of which is contacted with a right and a left side surfaces of the plate respectively, wherein the second supporting plate has a penetrating hole so that the bullets transferred along the spiral grooves can be passed out of the plate and into the shooting apparatus; and a bullet sorting apparatus.

2. A shooting game apparatus having a housing, an air compressor installed in the housing, and at least one shooting apparatus for shooting a bullet using compressed air supplied from the air compressor, comprising:

a bullet shooting pressure supplying means for supplying relatively high pressure using compressed air generated by the air compressor to the shooting apparatus so as to shoot a bullet;

a bullet delivering pressure supplying means for supplying relatively low pressure using compressed air generated by the air compressor to deliver a bullet so as to the shooting apparatus; and a controller which is electrically connected to the air compressor, the shooting apparatus, the bullet shooting pressure supplying means and the bullet delivering pressure supplying means for controlling thereof; and a bullet sorting apparatus including a bullet line-up means for lining up bullets, a bullet selecting means having a pair of selecting bars for selecting the bullets depending on a distance between the pair of selecting bars, and a driving means which is connected to one of the selecting bars of the bullet selecting means at one end portion thereof for providing rotary power to the bullet selecting means.

3. The shooting game apparatus in accordance with claim 2, wherein the bullet line-up means includes a base plate downwardly sloped and a line-up plate arranged perpendicularly to the base plate and separated from the base plate.

4. The shooting game apparatus in accordance with claim 3, wherein the bullet line-up means further includes a guide plate perpendicularly arranged to the base plate and not being separated from the base plate for guiding the bullets to the line-up plate.

5. The shooting game apparatus in accordance with claim 2, wherein the bullet sorting means includes a first selecting bar having spiral grooves formed on outer surface thereof and a second selecting bar separately arranged from the first selecting bar, wherein the bullets are supplied in a space between the first selecting bar and the second selecting bar.

6. The shooting game apparatus in accordance with claim 5, wherein the first selecting bar comprises three zones including a first zone, a second zone and a third zone depending on difference of depth of the spiral grooves, in which the first zone is formed for selecting bullets smaller than normal size of bullets or contaminant, the second zone is formed for selecting normal size of bullets, and the third zone is formed for selecting big bullets bigger than normal size of bullets or contaminant.

7. The shooting game apparatus in accordance with claim 5, wherein the second selecting bar comprises three zones including a first zone, a second zone and a third zone depending on difference of diameter of the second selecting bar, wherein the first zone is formed for selecting bullets smaller than normal size of bullets or contaminant, the second zone is formed for selecting normal size of bullets, and the third zone is formed for selecting big bullets bigger than normal size of bullets or contaminant.

8. The shooting game apparatus in accordance with claim 5, further comprising a bullet collecting section installed under the bullet selecting means to collect and supply the normal size of bullets.

9. The shooting game apparatus in accordance with claim 5, further comprising a motor overload prevention apparatus between the driving means and the first selecting bar.

10. The shooting game apparatus in accordance with claim 9, wherein the motor overload prevention apparatus includes:

a first coupling installed on a driving shaft for transferring rotary power of the driving means to the driving shaft;

a second coupling installed on an outputting shaft which operates by receiving the rotary power of the driving shaft; and a rotary power transfer means for transferring rotary power of the driving means from the first coupling to the second coupling, wherein the rotary power transfer means includes elastic members inserted into each of inserting holes formed on side surface of the front section of the first coupling and balls being received in the elastic members, the second coupling having inserting holes for receiving a part of the each ball on a side surface to which the first coupling is contacted.

11. The shooting game apparatus in accordance with claim 10, wherein the inserting holes are formed in radial type at regular intervals.

12. The shooting game apparatus in accordance with claim 11, wherein a separation protection member is fixed at entrance portion of each of the inserting holes.

* * * * *